US005682724A

United States Patent [19]

Randjelovic

[11] Patent Number: 5,682,724

[45] Date of Patent: Nov. 4, 1997

[54] RESILIENT SUBFLOOR PAD AND FLOORING SYSTEM EMPLOYING SUCH A PAD

[75] Inventor: Erlin A. Randjelovic, Crystal Falls, Mich.

[73] Assignee: Connor/AGA Sports Flooring Corporation, Amasa, Mich.

[21] Appl. No.: 531,644

[22] Filed: Sep. 21, 1995

[51] Int. Cl.[6] ..... E04B 5/43

[52] U.S. Cl. ..... 52/403.1; 52/480

[58] Field of Search ..... 52/403.1, 480, 52/393; 248/615, 618, 632, 634, 188.8, 188.9

[56] References Cited

U.S. PATENT DOCUMENTS

| | | | |
|---|---|---|---|
| Re. 26,239 | 7/1967 | Rockabrand et al. . | |
| 498,344 | 5/1893 | Williams . | |
| 1,818,298 | 8/1931 | Bowman . | |
| 1,908,639 | 5/1933 | Fisher . | |
| 2,088,566 | 8/1937 | Avery | 248/615 |
| 2,263,895 | 11/1941 | Larsen . | |
| 2,631,330 | 3/1953 | Becker | 248/615 X |
| 2,862,255 | 12/1958 | Nelson . | |
| 2,956,653 | 10/1960 | Liskey, Jr. . | |
| 3,107,377 | 10/1963 | Nathan . | |
| 3,191,896 | 6/1965 | Nathan . | |
| 3,425,652 | 2/1969 | Leary . | |
| 3,436,042 | 4/1969 | Van Goubergen . | |
| 3,440,787 | 4/1969 | Bataille . | |
| 3,473,281 | 10/1969 | Omholt . | |
| 3,542,322 | 11/1970 | Dvorin . | |
| 4,002,315 | 1/1977 | Van Goubergen . | |
| 4,003,174 | 1/1977 | Kotcharian . | |
| 4,420,135 | 12/1983 | Munz . | |
| 4,687,127 | 8/1987 | Pardo et al. | 248/634 X |
| 4,856,250 | 8/1989 | Gronau et al. . | |
| 4,860,516 | 8/1989 | Koller et al. | 52/480 |
| 4,869,479 | 9/1989 | Colonel et al. . | |
| 4,879,857 | 11/1989 | Peterson et al. . | |
| 4,890,434 | 1/1990 | Neise . | |
| 4,930,280 | 6/1990 | Abendroth . | |
| 5,277,010 | 1/1994 | Stephenson et al. | 52/403.1 |
| 5,303,526 | 4/1994 | Niese | 52/393 |
| 5,365,710 | 11/1994 | Randjelovic . | |

FOREIGN PATENT DOCUMENTS

| | | | |
|---|---|---|---|
| 0 455 616 A1 | 6/1991 | European Pat. Off. . | |
| 18671 | 2/1899 | France . | |
| 268762 | 1/1927 | Germany . | |
| 38 38 733 A1 | 5/1990 | Germany . | |
| 0122085 | 8/1927 | Switzerland | 248/615 |
| 466476 | 5/1937 | United Kingdom . | |

OTHER PUBLICATIONS

Lord Manufacturing Co. Bulletin 100, Shear Type Mountings, 1933, 248/634 4 pages.

Brochure regarding Connor/AGA Sports Facilities Specialists, *Performance Engineered Wood Flooring Systems*, 1993, 09550/CON.

Brochure regarding Horner Flooring Co., *Horner Sports Floor Systems*, 1994.

*Primary Examiner*—Robert Canfield

*Attorney, Agent, or Firm*—Merchant, Gould, Smith, Edell, Welter & Schmidt, P.A.

[57] ABSTRACT

A resilient pad for resiliently supporting a floor on a substrate is disclosed. The resilient pad includes a resilient inner element and an outer element which surrounds the inner element. The outer element is made of a material which is of higher durometer than the inner element, and is lower in profile than the inner element. Preferably the outer element is non-resilient. Under normal loads applied to the floor, the softer inner element contacts the substrate, resulting in desirable floor response characteristics. Under heavy loading, the harder outer element comes into contact with the substrate, thus supporting the floor and preventing damage to the inner element.

6 Claims, 3 Drawing Sheets

RESILIENT SUBFLOOR PAD AND FLOORING SYSTEM EMPLOYING SUCH A PAD

BACKGROUND OF THE INVENTION

The present invention relates generally to resilient pads which are placed under sports floor systems such as gymnasiums, exercise floors, and the like. More particularly, the invention relates to such a pad that responds quickly and at a desirable deflection to sports activity while also providing a load characteristic which prevents damage to the pad.

It is generally known to provide cushioning pads under a sports floor system in order to provide resiliency to the floor. In such known systems the amount of cushioning is mainly controlled by the durometer (hardness) of the material as well as the dimensions of the contact area in touch with either the underside of the subfloor or the concrete substrate. There are both advantages and disadvantages to using either hard or soft material as well as varying the size of the contact area with either the subfloor or concrete substrate.

The advantage of a soft, low durometer material is in providing greater cushioning. However, this approach is a disadvantage when providing loads such as bleachers, stages, weight room equipment and other such items which create loads on the system detrimental to the cushion's integrity. Soft pads are also particularly prone to a problem known as "compression set," i.e., the tendency of the pad to lose its resiliency when placed under a high load for extended periods of time.

The advantage of hard high durometer material is in providing greater loading capacity to the system without damaging the cushions. However this design detracts from the system's resiliency and cushioning for the athletes performing on the floor.

Additionally, the typical method of adhering resilient cushions to the underside of the subfloor is by means of mechanically fastening staples through extended tabs protruding from the cushion sides. While this manner is satisfactory in the harder high durometer pads, the soft low durometer pads typically will not accept the fasteners without tearing through the tabs.

Attempts have been made to create a "two stage" pad design which provides desirable response characteristics under both light and heavy loads. One such cushioning pad is shown in U.S. Pat. No. 4,879,957 to Peterson.

The Peterson design discloses a pad having a large frusto-spherical portion and a smaller dome section. The purpose of the dome section is to provide a large amount of resiliency under very light loads. Under greater loads the frusto-spherical portion (along with the dome section) is designed to provide greater resistance to compression and loading fatigue.

The resilient pad of Peterson, and other similar resilient pads in shapes such as conical, pyramid and spherical, have substantial disadvantages. First, these pads are comprised of a material having only one durometer. In installations such as aerobic facilities, a high shock absorbing floor is preferred and typically specified by the owner. This type of installation requires very low durometer pads which provide high shock absorption values; however these soft pads are not capable of sustaining heavy loads such as stair steppers, tread mills, weight machines and other such devices which the owner often prefers to position on the floor to satisfy his clients.

The current remedy to this problem in such installations is the industry practice of partial blocking. Partial blocking is a method in which soft wood, plywood or other such rigid material is provided in a thickness less than the profile height of the resilient cushion. This allows the subfloor to rest or "bottom out" on the rigid material without further stressing the cushion once the deflection has gone beyond an athletic load. This procedure is time consuming to the installer and adds additional cost for material and labor. Furthermore, the addition of rigid material to the underside of the subfloor detracts from the flexibility of the floor system and so reduces the preferred shock absorption.

The disadvantage of low, single durometer pads is not limited to aerobic facilities. Often owners and specifiers prefer highly shock absorbent floors in gymnasium installations. These facilities typically have bleacher areas which exert loads beyond the acceptable limit of the low durometer pads. Again a frequent safeguard to protect the low durometer pads is the introduction of partial wood blocking.

Another alternative for prior art pads is to change to higher durometer pads beneath the subfloor where the bleachers exist in the extended positions. However, the gymnasium is often in use while the bleachers are in the stacked position against the wall. This results in a different performance characteristic for both the shock absorption and the ball rebound when traversing across differing shock absorbing durometers.

Finally, low durometer pads do not lend themselves to typical mechanical fastening. Often these pads dislodge from the subfloor prior to positioning the subfloor panels. If unnoticed a missing cushion will cause a non-uniform playing surface. Also, under very high loads, pads such as those made according to the Peterson patent have been known to crack at the flat base portion.

A cushion currently available as the SAFE pad by Horner Flooring Company of Dollar Bay, Mich., does provide two materials having different durometer in the same pad. However this pad provides lower durometer inserts which are placed horizontally, rather than vertically, into the outer higher durometer shell. This design requires that both the outer and inner elements of the pad are resilient. Therefore the outer element cannot be manufactured of hard non-resilient material to accept heavy service loads. Rather, the outer shell is a flexible high durometer material which must deflect with the inner element. In addition, the effects of providing a very low durometer insert is limited when compared to the present invention, which provides direct contact of a low durometer insert against the substrate.

SUMMARY OF THE INVENTION

The present invention includes a resilient pad for placement under a floor system. The pad is made up of a highly resilient, low durometer inner element. Surrounding the low durometer element is a high durometer outer load ring. The outer load ring element is lower in profile than the inner pad element. Consequently the inner element deflects under light loads and can only deflect to the point where the outer ring element comes in contact to the substrate.

The outer load ring is preferably made of a material which is non-resilient. As used herein, "non-resilient" means that the load ring does not compress in use, even under heavy loads. The resiliency of a material which will compress when used in a flooring system is generally measured in the industry according to the "Shore A" durometer scale. For example, the inner pad element of the present invention is preferably between 50–70 durometer, Shore A. On the other hand, a non-resilient material, i.e., one which does not compress even under heavy loading, generally has a hardness which is above the Shore A durometer scale, and instead is measured according to the Shore D durometer scale.

In addition to being non-resilient, the load ring is preferably designed such that the inner dimensions of the load ring are exact to the bottom dimensions of the inner element. This is a very important features of the invention since splitting of current low durometer pads initiates at the flat base. The hard non-resilient outer ring element contains the base of the inner pad element. Forces which cause the base to widen and consequently split are counteracted by the surrounding hard, non-resilient ring element. The outer diameter ring also provides a base for the inner area element to adhere. In addition, the outer diameter ring provides two side tabs to allow mechanical fastening of the pad to the underside of the subfloor. Since the fastening tabs are comprised of the same hard high durometer material as the outer ring element, tearing of low durometer fastening tabs is no longer a concern.

Preferably, the inner pad element is conical in shape and the outer load element is in the form of a surrounding ring. However, the inner element may be made of other shapes, such as pyramidal, hemispherical, rectangular and square. Likewise, the surrounding load area of the ring may comprise shapes such s triangles, squares, rectangles, diamond shapes and others.

Although both the inner element and the outer ring element may be made of the same material, such as urethane, synthetic rubber, natural rubber, neoprene, or PVC, it is not necessary that both the inner and outer elements be comprised of the same material. For example, the inner element may comprise a material much more suited to flexibility and fatigue resistance, while the outer load element comprises a dense, non-flexible material. The outer element of the pad may also comprise a material which maintains higher integrity when penetrated by fasteners than elastomer type materials.

The placement and adhesion of the inner element to the outer element of the pad may be accomplished in a number of ways. The pad may be manufactured in a two step process by which the inner element is formed first and then placed in the ring mold, allowing formation of the outer element to coincide with adhesion of the inner element to the outer ring. This process may also be reversed to allow the outer element to be placed in a mold while the inner element is processed and adhered to the outer element. This process may or may not include the manufacturing process of injection molding.

Another manner of manufacturing may provide both the inner elements and outer elements in separate units. This would allow the outer elements to be used as required by inserting the inner element with the preferred hardness. The inner elements could be adhered to the outer elements with adhesive.

The resilient cushion of the present invention provides desirable deflection and consequent shock absorption with the preferred inner pad element softness. The desired shock absorption is provided without regard to service load associated to other single durometer pads. The cushioning pads of the present invention may be employed in high load areas, such as under bleachers, without the need for additional rigid subfloor materials required with other quick responding resilient pads.

Performance testing has been performed which demonstrates the superior load blocking of the present invention. While low durometer pads subjected to loads for a (4) four day period split and resulted in compression set, pads of identical design, material and hardness did not split or show excessive compression set when subjected to (3) three times the load for a period of (4) four weeks when restrained at a set load height.

The invention also includes a flooring system employing the resilient pads described above.

DETAILED DESCRIPTION OF THE PREFERRED EMBODIMENT

Figure 1:
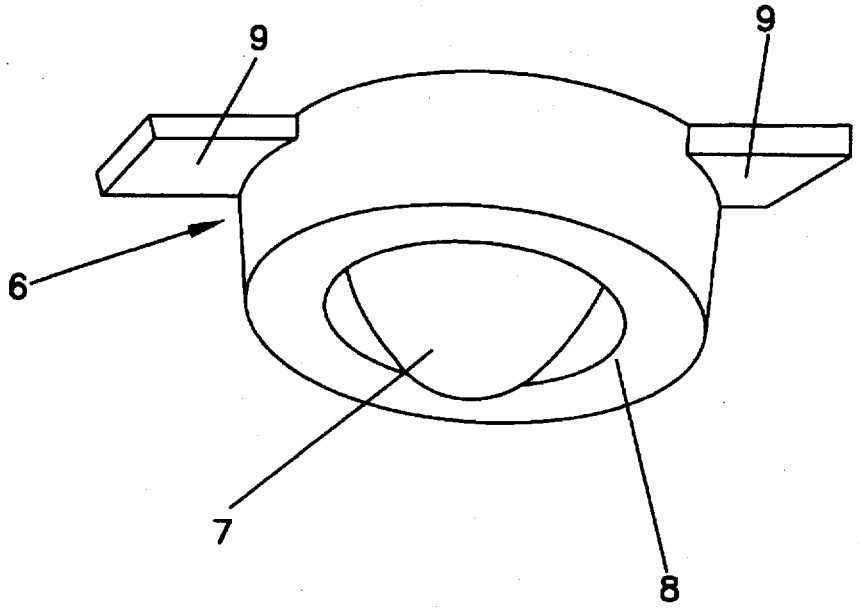
FIG. 1 is a perspective view of the resilient pad of a preferred embodiment of the present invention.

The resilient pad 6 of the preferred embodiment is shown in FIG. 1. As shown therein, the pad of the preferred embodiment is made up of an inner element 7 and an outer element 8. The inner element 7 is provided in a conical shape having a generally rounded tip, and is made of an elastic material of a low durometer value. According to the preferred embodiment, the outer element 8 is provided as a surrounding ring made of a non-resilient material.

The extending tabs 9 are provided and preferably are made of the same material as the outer ring 8. The extending tabs may be manufactured in the same mold as the surrounding ring element to form a solid one piece unit.

The inner pad element 7 is adhered to outer pad element 8 by bonding to the inner base of element 8 either as separate pieces later adhered or as one element molded to the other during the manufacturing process.

The pad elements 7–8 can be made out of a variety of materials, such as urethane, synthetic rubber, natural rubber, neoprene or pvc. Pad element 8 can be made of the same material in a non-resilient form, as well as hard plastic or other such material not providing resiliency. The most preferred material is urethane with the inner element 7 providing 50–70 durometer (Shore A) and the outer element 8 being a non-resilient material beyond Shore A hardness.

Figure 2:
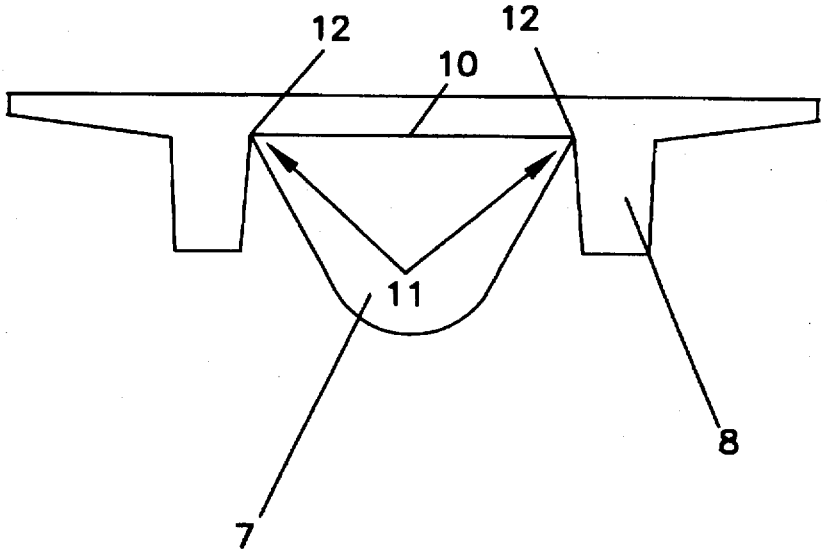
FIG. 2 is a cross-sectional view of the resilient pad of FIG. 1.

The cross-sectional view of FIG. 2 shows the details of the bonding area 10 of the inner element 7 and the outer element 8. The inner diameter 11 of the outer element 8 is the same dimension as the base diameter 12 of the inner element 7. This design forces the deflection of the inner element 7 to occur primarily at the tip of the conical inner element, thus countering the stresses to the base of the pad where splitting typically occurs in resilient cushions.

Figure 3:
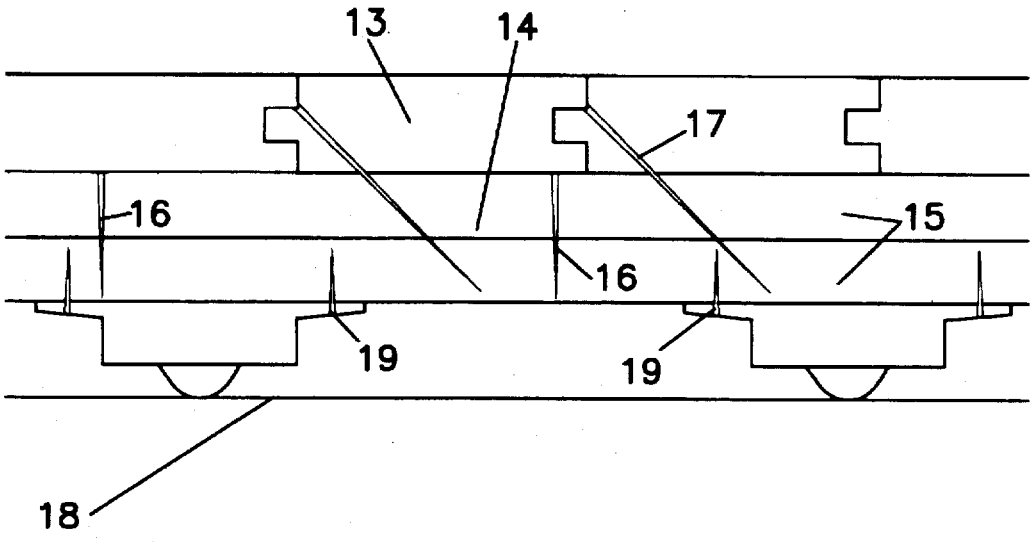
FIG. 3 is a sectional view of a portion of a floor system employing resilient pads made according to the preferred embodiment of the present invention.

A typical floor system with which the resilient pad of the present invention can be used is shown in FIG. 3. This floor system is made up of flooring 13 attached to a subfloor 14. Flooring 13 is generally made up of hardwood strips which are connected together by tongue and groove arrangement. Subfloor 14 is commonly made up of two layers of plywood 15 connected together by staples 16. Flooring is preferably attached to the subfloor by way of staples or nails 17 driven in above the tongue of the floor strips. Also shown in FIG. 3 is the substrate 18 over which the flooring system is laid. Substrate 18 is typically a concrete layer or the like. Two resilient pads 6 made according to the present invention are shown in FIG. 3. The pads are disposed between the subfloor 14 and the substrate 18. The stapling tabs 9 are comprises of a non-resilient material capable of maintaining its integrity when fastened to the lower subfloor panel 15 by means of staples or nails 19. The preferred thickness of the side tabs 9 is approximately ⅛".

Figure 4:
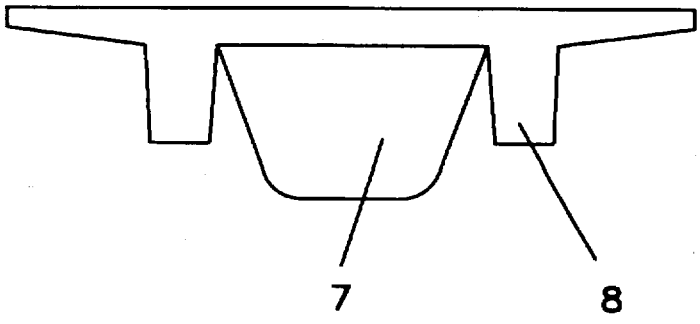
FIG. 4 is a cross-sectional view of the resilient pad of FIG. 1 shown under light load conditions.

FIG. 4 shows the effects of light loads, such as the weight of the floor system itself or of a single athlete performing. As seen in FIG. 4, the inner pad element 7 responds quickly but is not yet reduced to the same profile height of the load element 8, thus reserving additional deflection capabilities for greater athletic loads.

Figure 5:
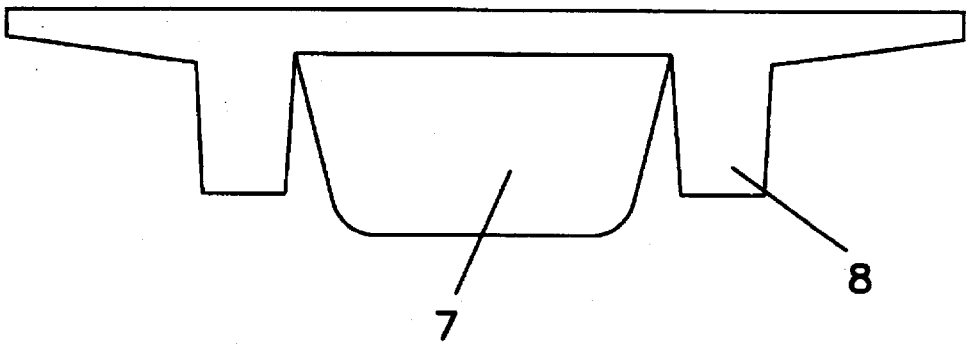
FIG. 5 is a cross-sectional view of the resilient pad of FIG. 1 shown under moderate load conditions.

FIG. 5 shows the effects of increased loading on the resilient pads. The inner pad element 7 compresses further as a result of additional athletic load. However, the inner pad element 7 has still not yet been reduced to the same profile height as the outer pad element 8.

Figure 6:
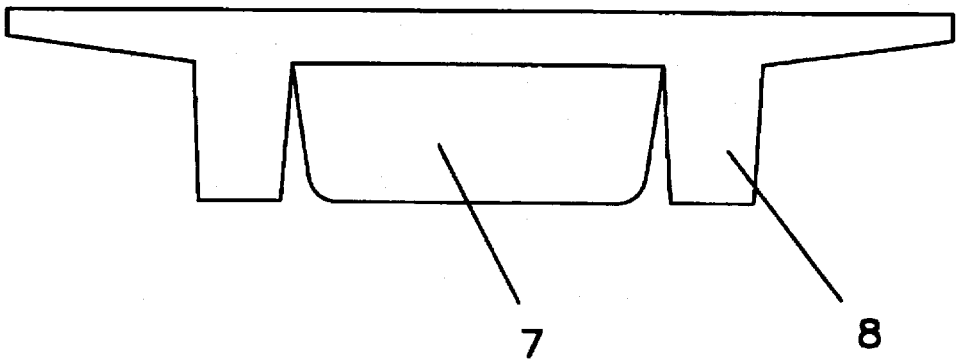
FIG. 6 is a cross-sectional view of the resilient pad of FIG. 1 shown under heavy load conditions.

FIG. 6 shows the resilient pad under a load which surpasses those achieved under athletic conditions. Loads such as bleachers, maintenance equipment, athletic equipment, etc. cause the inner element 7 to be reduced in profile to that of the outer element 8. The outer element 8 maintains its profile without deflecting, thereby protecting the integrity and continued resilient performance of the inner element 7 once the service load has been removed.

The preferred profile difference between the inner element 7 and the outer element 8 can be determined through performance testing. The overall height of elements 7–8 as well as widths of the inner element 7 and wall thickness of outer element 8 may be adjusted accordingly in regards to athletic and service loads. In a standard system such as the one shown in FIG. 3, the preferred overall height is ¾", with the outer element having a height of about ½"

The number and spacing of the resilient pads in the floor system can also affect the characteristics of the floor system. Again, optimum results can be achieved through performance testing with the particular floor system.

The foregoing constitutes a description of the preferred embodiment of the invention. Numerous modifications are possible without departing from the spirit and scope of the invention. For example the inner pad element need not be conical but can have different cross section shapes. The outer element need not be circular and may provide different surrounding shapes. The invention need not be used with the floor system shown in FIG. 2, but can be used with floor systems of various types. Thus, the scope of the invention should be determined with reference, not to the preferred embodiment, but to the appended claims.

I claim:

1. A resilient flooring system supported by a substrate, comprising:

a floor comprising a floor surface layer and a subfloor layer;

a plurality of resilient pads attached to said subfloor layer, each of said resilient pads comprising a resilient inner element and a substantially non-resilient outer element surrounding the inner element, the outer element being lower in profile than the inner element and made of a material of higher durometer than the inner element, whereby the outer element comes into contact with both the floor and the substrate upon application of a heavy load to the flooring system that surpasses loads achieved under athletic conditions, the outer element maintaining its profile without deflecting under the heavy load.

2. The resilient flooring system as claimed in claim 1, wherein said outer element is made of a material which is non-resilient, and said inner element is made of a material which has a hardness of 50–70 durometer (Shore A).

3. The resilient flooring system as claimed in claim 1, wherein the outer element of each of said resilient pads defines an opening in which one of the inner elements is inserted, and wherein the inner element of each of said resilient pads has a base portion which is of substantially the same dimensions as said opening.

4. The resilient flooring system as claimed in claim 1, wherein the outer element of each of said resilient pads is substantially ring-shaped and defines an opening in which one of said inner elements is inserted, said opening being substantially circular in cross-section, and wherein the inner element of each of said resilient pads is substantially conical in shape.

5. The resilient flooring system as claimed in claim 4, wherein the inner element of each of said resilient pads has a base portion which is of substantially the same dimensions as the opening in the outer element of said resilient pads.

6. The resilient flooring system as claimed in claim 1, wherein the outer element of each of said resilient pads comprises a ring and at least one attachment tab connected to the ring for attaching the outer element to the subfloor layer, the attachment tabs being made of the same material as the ring.

* * * * *